US007490654B2

(12) United States Patent
Gomaa et al.

(10) Patent No.: US 7,490,654 B2
(45) Date of Patent: Feb. 17, 2009

(54) ROLLING DOOR ASSEMBLY HAVING PASS DOOR ARRANGEMENT

(75) Inventors: Ashraf Gomaa, Staten Island, NY (US); Darryl F. Ducharme, Cypress, CA (US); Jon-Ryan Pritchard, Rancho Cucamonga, CA (US)

(73) Assignee: McKeon Rolling Steel Door Co., Inc., Brooklyn, NY (US)

( * ) Notice: Subject to any disclaimer, the term of this patent is extended or adjusted under 35 U.S.C. 154(b) by 214 days.

(21) Appl. No.: 11/436,780

(22) Filed: May 18, 2006

(65) Prior Publication Data

US 2007/0272367 A1 Nov. 29, 2007

(51) Int. Cl.

| | |
|---|---|
| ***E06B 3/48*** | (2006.01) |
| ***E06B 7/28*** | (2006.01) |
| ***E05F 15/20*** | (2006.01) |
| ***E04F 10/08*** | (2006.01) |

(52) U.S. Cl. ..... 160/116; 160/9; 160/33; 160/180

(58) Field of Classification Search ..... 160/116, 160/133, 180, 201, 273.1, 90, 92, 97, 98, 160/9; 292/150, 159, 183, 184, 187, 332, 292/333, 334, 60, 72, 92, 93, DIG. 15, DIG. 36; 49/311, 314, 316, 394, 466

See application file for complete search history.

(56) References Cited

U.S. PATENT DOCUMENTS

| | | | | |
|---|---|---|---|---|
| 2,717,064 | A * | 9/1955 | Hock | 49/394 |
| 4,217,731 | A | 8/1980 | Saino | |
| 4,461,120 | A | 7/1984 | Hemmerling | |
| 5,577,541 | A * | 11/1996 | McKeon | 160/7 |
| 7,029,078 | B1 * | 4/2006 | Fromme et al. | 312/217 |

* cited by examiner

*Primary Examiner*—Katherine W Mitchell
*Assistant Examiner*—Jeremy C Ramsey
(74) *Attorney, Agent, or Firm*—Cohen Pontani Lieberman & Pavane LLP

(57) ABSTRACT

A rolling door assembly for selectively covering an opening in a building includes a shutter roller rotatable about a substantially horizontal axis and a flexible panel windable on and off the roller for movement into retracted and extended positions, respectively. The flexible panel defines an upper portion having a first width and a lower portion having a second width less than the first width. At least one pass door frame is hingedly securable proximate a lateral side of the opening for movement between a first position, in which the pass door frame extends in a substantially transverse direction relative to the opening and a second position, in which the pass door frame is substantially aligned with the at least one sidewall. A pass door is movably mounted within the passage defined by the pass door frame to selectively provide ingress and egress therethrough and a closure system is provided for causing the pass door frame to move from the second position to the first position after extension of the flexible panel.

19 Claims, 8 Drawing Sheets

16b
17
19
7o
23
28

16o
17o
42
24
24o
44

ROLLING DOOR ASSEMBLY HAVING PASS DOOR ARRANGEMENT

BACKGROUND OF THE INVENTION

1. Field of the Invention

The present invention relates generally to a movable door for selectively covering an opening in a wall, and more particularly to an improved egress assembly in the movable door for allowing passage therethrough when the wall opening is covered.

2. Description of the Related Art

A "labeled" door assembly is defined by the National Fire Protection Association as a combination of a door, hardware and other accessories which together provide a specific degree of protection to an opening when closed and to which has been attached a label or other identifying mark to indicate compliance with nationally recognized standards or tests. Conversely, all other door assemblies are referred to as "non-labeled" door assemblies.

For emergency egress purposes, various building codes and the like require any building having either a slide-type or rolling type door assembly to include both a fire door positionable to close an opening and a hinged-type wicket or pass door for passage therethrough when the opening is closed by the fire door. In some cases, compliance with the above requirement may be achieved merely by providing the pass door in the wall of the building adjacent the fire door. Alternatively, a pass door may be incorporated into the movable fire door itself. In U.S. Pat. Nos. 4,217,731 and 4,461,120, for example, there are shown fire door assemblies which include a single hinged pass door in a sliding fire door for allowing passage through the sliding fire door. As will be readily appreciated, however, sliding fire doors may be unattractive to building designers because of the need to provide adjacent wall space to accommodate them. This same need for adjacent space may also complicate or frustrate efforts to retrofit a sliding door over an existing opening.

In an effort to avoid the space problems and other disadvantages associated with slide-type door assemblies, rolling door assemblies, which include a shutter curtain that is raised or lowered from a roller positioned above the opening, have been developed. Typically, two vertically disposed channels are positioned adjacent opposite lateral sides of the opening to guide the shutter curtain as it is retracted or extended between the opened and closed positions.

While a service door configuration is known in which a pass door frame is hingedly connected to a vertical, shutter guide channel to provide passage when the rolling curtain service door is closed, this configuration utilizes a door frame structure that must be manually positioned and locked prior to extension of the shutter curtain. As such, this configuration can not be utilized in self-closing fire door applications in which the rolling door is closed automatically, such, for example, in response to detection of a fire.

U.S. Pat. No. 5,577,541 discloses a rolling door assembly having a pass door arrangement. A vertical edge of the pass door frame serves as a channel in which an edge of the narrow section of a flexible door panel or curtain is guided as the curtain moves to its closed position. An alignment member or "floating bar" is movably attached to a leading edge of the narrow section of the curtain and rests on the top of the pass door frame as the curtain is closed. Because of this arrangement, the pass door frame should be close to or in its closed position prior to engagement with the narrow section of the curtain so that the edge of the narrow, section of the curtain is guided along the channel in the pass door frame.

SUMMARY OF THE INVENTION

Accordingly, it is an object of the present invention to provide a self-closing fire door assembly which provides emergency egress through a protected opening while avoiding the operation requirements noted above in connection with prior art labeled door assemblies. This object, as well as others which will become apparent from the teachings set forth herein to those skilled in the art, are achieved by a fire door assembly that includes a shutter roller rotatable about a substantially horizontal axis, means for rotating the shutter roller and a flexible panel windable on and off the shutter roller for movement into retracted and extended conditions, respectively. The flexible panel defines an upper portion having a first width and a lower portion having a second width less than the first width.

In accordance with one aspect of the present invention, the door assembly includes a pass door frame hingedly securable proximate a lateral side of the opening for movement between a first position, in which the pass door frame extends in a substantially transverse direction relative to the opening and a second position, in which the pass door frame is substantially aligned with a sidewall of the opening. The pass door frame includes a vertical edge for engaging an edge region of the flexible panel lower portion while in the first position to create a seal therebetween.

A pass door is movably mounted within the passage defined by the pass door frame to selectively provide ingress and egress therethrough. The door assembly of the present invention further includes closure means for causing the pass door frame to move from the second position to the first position.

In accordance with one embodiment of the present invention, a sliding guard moveable member is positioned along a vertical edge of the pass door frame opposite an opposing vertical edge of the narrow position of the curtain. The moveable member is engaged to move the member from a second undeployed position to a first deployed position for sealing the pass door frame and curtains to each other.

In accordance with one embodiment of the present invention, a vertical edge of the pass door frame opposite an opposing vertical edge of the narrow portion of the curtain contains a magnetic region for attracting the opposing vertical edge of the curtain as the door frame moves to its first position.

In accordance with one embodiment, a fire door assembly for protecting a building opening defined by at least one lateral sidewall is disclosed having a shutter roller rotatable about a substantially horizontal axis, means for rotating the shutter roller, a pair of alignment rails positioned on either side of the building opening, and a flexible panel windable on and off the roller for movement into retracted and extended conditions. The flexible panel defines an upper portion having a first width and a lower portion having a second width less than the first width. A leading edge of the lower portion has an aligning member whose ends are guided in the alignment rails. A pass door frame is hingedly secured to or proximate a lateral side of the opening for movement between a first position in which the pass door frame extends in a substantially traverse direction relative to the opening, and a second position in which the pass door frame is substantially aligned with the sidewall. The pass door frame has a vertical overlap region extending over a vertical edge on one side of the lower flexible panel portion when the flexible panel is in the extended condition and the pass door frame is in the first position. The pass door frame has a movable overlap member mounted opposite a side of the vertical overlap region for movement from an undeployed position to a deployed position over the vertical edge along the opposite side of the lower portion of the flexible panel, so that when the member is in the deployed position, the vertical edge is positioned between the vertical overlap region and the member. A release means causes the movable member to move to the deployed position. A pass door is moveably mounted within the passage defined by the pass door frame to selectively provide ingress and egress therethrough. A closure means is also provided for causing the pass door frame to move to the first position after extension of the flexible panel.

Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE PRESENTLY PREFERRED EMBODIMENTS

Figure 1:
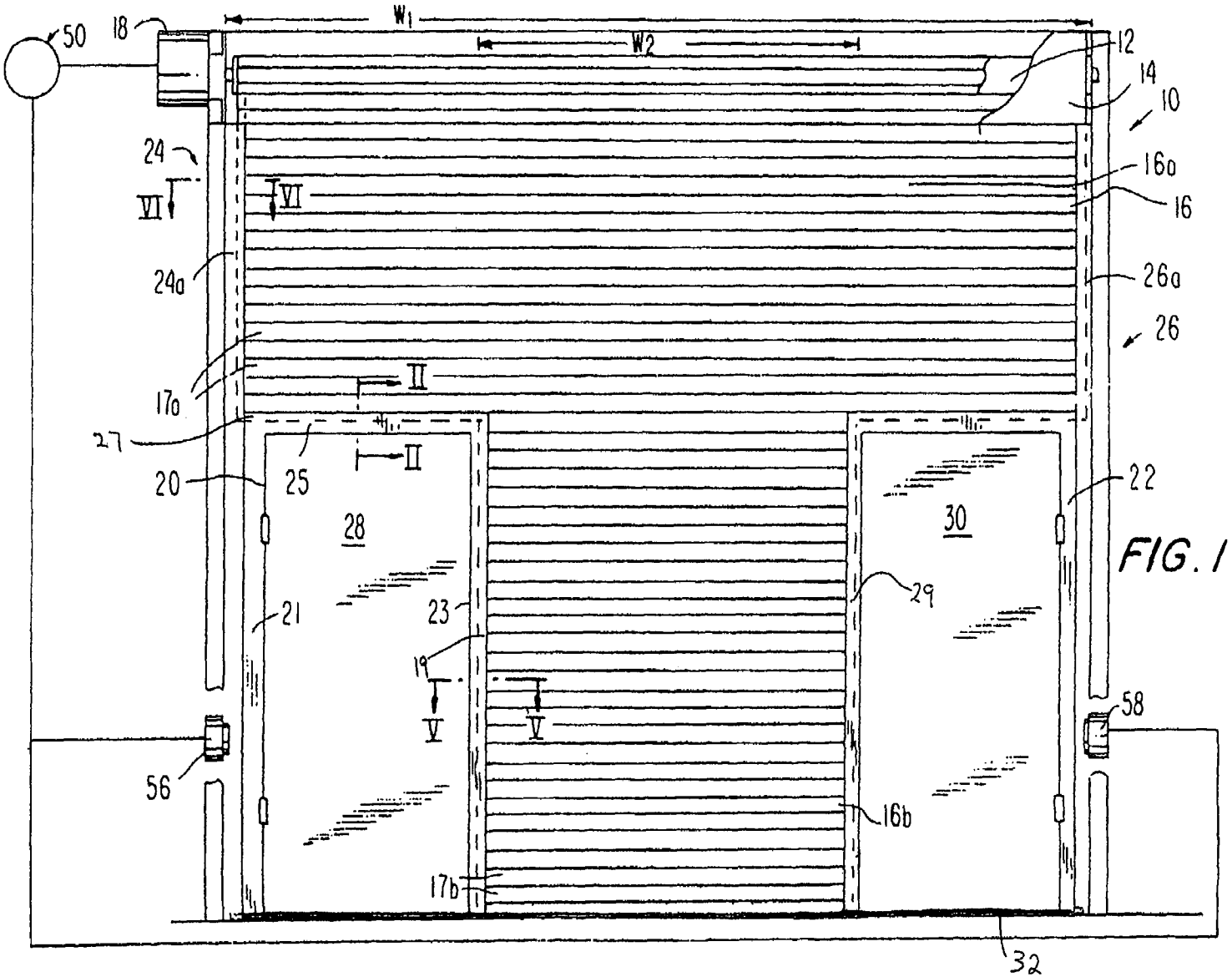
FIG. 1 is a front elevation view of a fire door assembly constructed in accordance with an illustrative embodiment of the present invention, with the flexible door panel and pass door frames shown in their respective closed positions across an opening.
Figure 4:
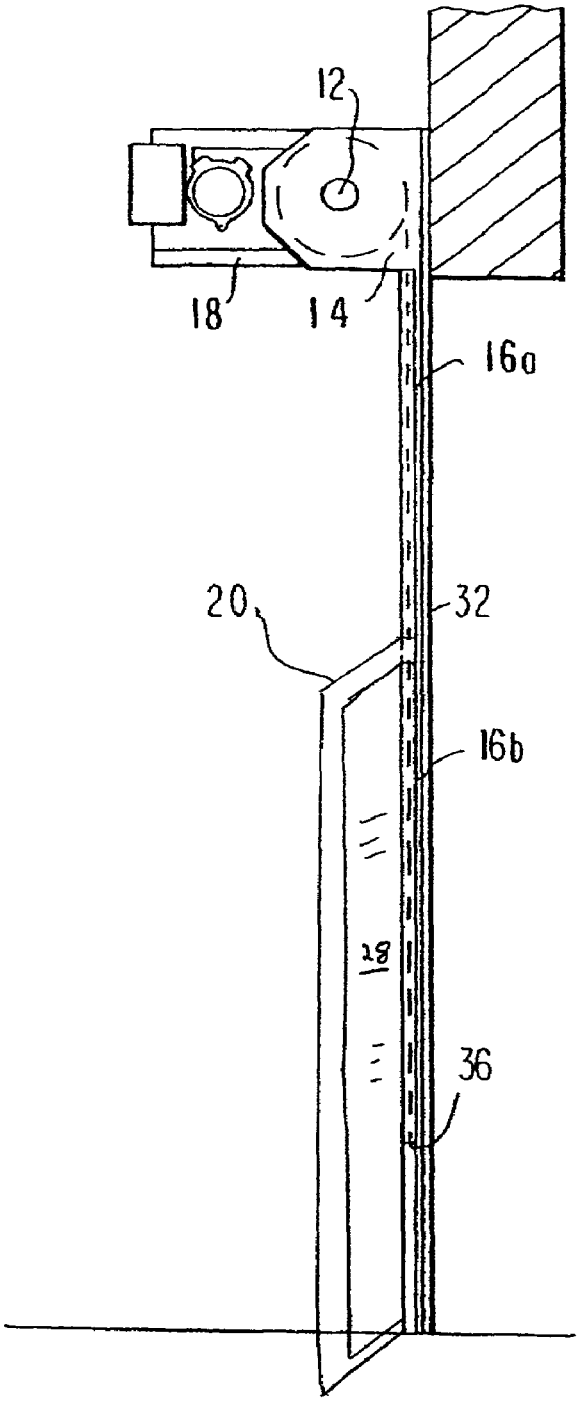
FIG. 4 is a side elevation view taken in cross-section showing continued extension of the flexible door panel beyond the position shown in FIG. 3.

With initial reference to FIG. 1, there is shown an illustrative door assembly 10 embodying the invention and comprising a shutter roll 12 horizontally and rotatably arranged within a housing 14. Wrapped about shutter roll 12 is a flexible door panel 16. In the illustrative embodiment of the present invention depicted in FIG. 1, door assembly 10 is a labeled fire door assembly and flexible door panel 16 is formed from a plurality of horizontal metallic slats 17*a*, 17*b* that are articulated together in a known manner. The principal advantages of roll-type door structures are derived from their minimal space requirements and out-of-the way placement above an opening when in an inactive condition. As will be readily appreciated by those skilled in the art, the flexible door panel employed in a roll-type door structure need not be of an articulated slat configuration and any suitable rolling door configuration possessing the desired characteristics of flexibility, durability, and if applicable, resistance to fire, may be utilized.

When not needed, flexible door panel 16 may be maintained entirely within housing 14 while in a wound, retracted condition but may also, in accordance with an operating sequence to be described in detail later, be unwound by a conventional power drive means 18 into the extended condition shown in FIG. 1. It should be noted that power drive means 18 is not considered a novel aspect of the present invention and that any suitable means may be employed to rotate shutter roll 12 to thereby cause extension or retraction of flexible door panel 16. Because suitable mechanisms for this purpose are well known in the art, a detailed description of the same has therefore been deemed unnecessary and has been omitted for clarity.

With continued reference to FIG. 1, it will be seen that flexible door panel 16 has an upper portion 16*a* of a width $W_1$ and a lower portion 16*b* of a width $W_2$ that is less than $W_1$ by an amount sufficient to accommodate, when extended, at least one pass door frame 20. In the illustrative embodiment of FIG. 1, door assembly 10 further includes a second pass door frame 22, with each door frame being disposed at opposite lateral sides of the opening and movable into the transverse or closed position relative to the opening as shown.

As will be described in detail below, first and second vertical track members 24, 26 define recesses 24*a*, 26*a*, respectively, for receiving and guiding corresponding lateral edge regions of upper portion 16*a* and of an aligning member 32, the latter of which provides stability for the lower portion 16*b* as the flexible door panel is moved between its opened and closed positions. Mounted within the passage defined by each of pass door frames 20 and 22, is a corresponding hinged personnel or pass door 28, 30. When flexible panel 16, door frames 20, 22, and pass doors 28, 30 are positioned as shown in FIG. 1, a fire barrier is established across the opening. Emergency egress or ingress is obtained through flexible panel 16 via one or both of pass doors 28, and 30.

As is apparent from FIG. 1, vertical track members 24 and 26 are too far apart to guide lower portion 16*b* during initial extension of flexible door panel 16 from the retracted or wound position. In accordance with the present invention, the aligning member 32 is provided to ensure proper alignment of the lower portion 16*b* with the inwardly facing edges of door frames 20 and 22. In the illustrative door assembly 10 of FIG. 1, the aligning member 32 spans substantially the entire width of the opening, with opposite lateral ends thereof being received for guided movement within the inwardly facing grooves 24*a*, 26*a* of vertical track members 24 and 26.

Figure 2:
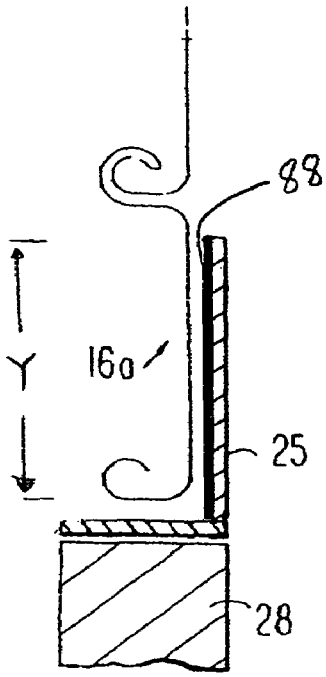
FIG. 2 is a partial cross sectional view taken across line II-II in FIG. 1.
Figure 8:
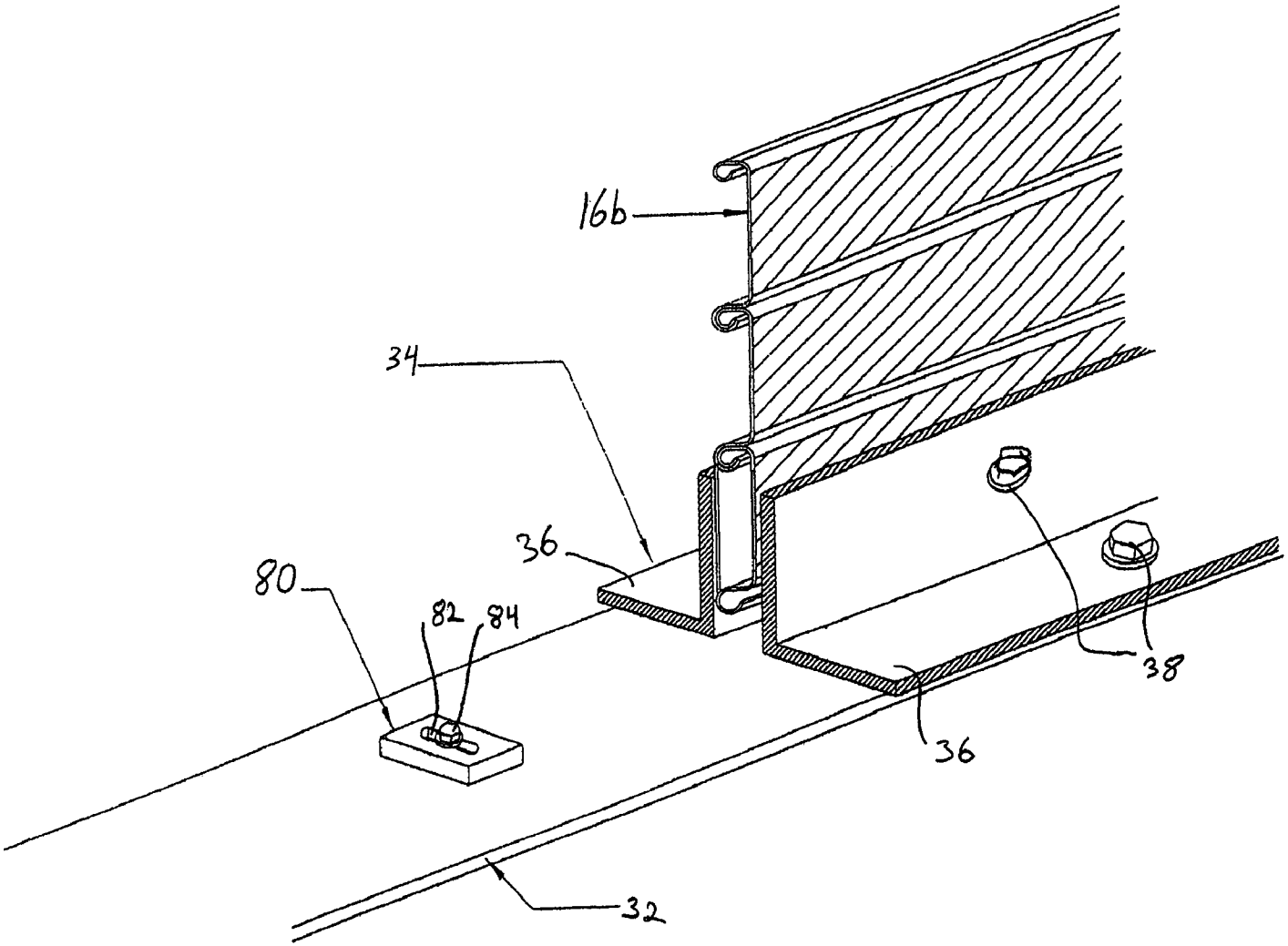
FIG. 8 shows the connection between the flexible door panel and an alignment number.

As best shown in FIG. 2, an upper frame section 25 of the pass door frame 20 overlaps a bottom edge of the upper, wide portion 16*a* of the door panel 16 when the door panel is fully deployed. This upper frame section may be in the form of an "L" bracket mounted to the top of the pass door frames. A leading edge of the lower portion 16*b* is fixedly connected to the aligning member 32 such as by welding or other known techniques. With reference to FIG. 8, for example, a connecting member 34 consisting of a pair of "L" brackets may be used to connect the leading edge of the flexible door panel to the aligning member 32 such as by bolts 38.

Figure 3:
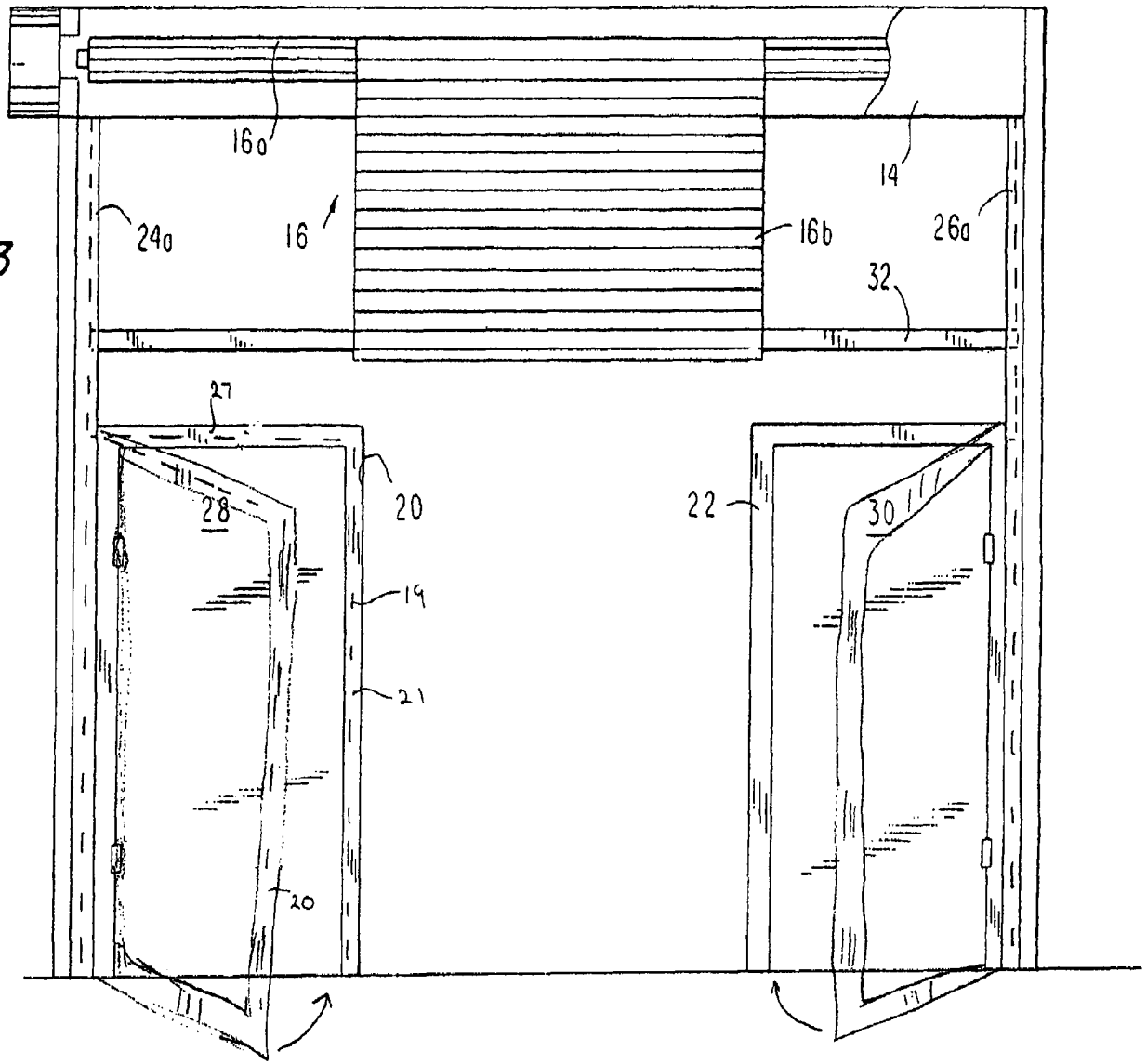
FIG. 3 is a front elevation view of the fire door assembly of FIG. 1, with the flexible door panel shown in a partially extended position and the pass door frames shown in a transition position after its second position transverse to the narrow section of the flexible panel.

In the illustrative door assembly 10 of FIG. 1, both pass door frames 20, 22 are shown as being of substantially identical construction. Accordingly, only pass door frame 20 will be hereinafter described in detail. As seen in FIG. 1, pass door frame 20 is of a substantially rectangular construction and includes first and second vertical frame sections 21 and 23 interconnected by an upper transverse frame section 25. The vertical frame section 23 is dimensioned to overlap the edges of the narrow bottom part 16*b* of the flexible panel 16 when the panel is in its closed position so that an overlap portion 19 extends over an opposing edge of the narrow bottom part 16*b*, and an overlap portion 29 (for frame 22) extends over the other opposite edge of the bottom part 16*b* as shown in FIGS. 1 and 3. Likewise, the upper frame section 25 of each pass door frame has a portion 27 which overlaps a leading edge of the upper wide portion 16*a* of the flexible panel when the panel 16 is closed and the pass door frames are then deployed as shown in FIG. 3 to their full panel-engaged positions as shown in FIG. 1.

Figure 5:
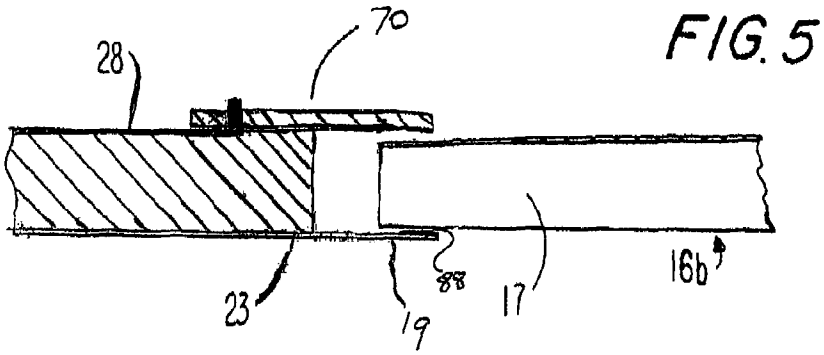
FIG. 5 is a partial cross sectional view taken across line V-V in FIG. 1.
Figure 10:
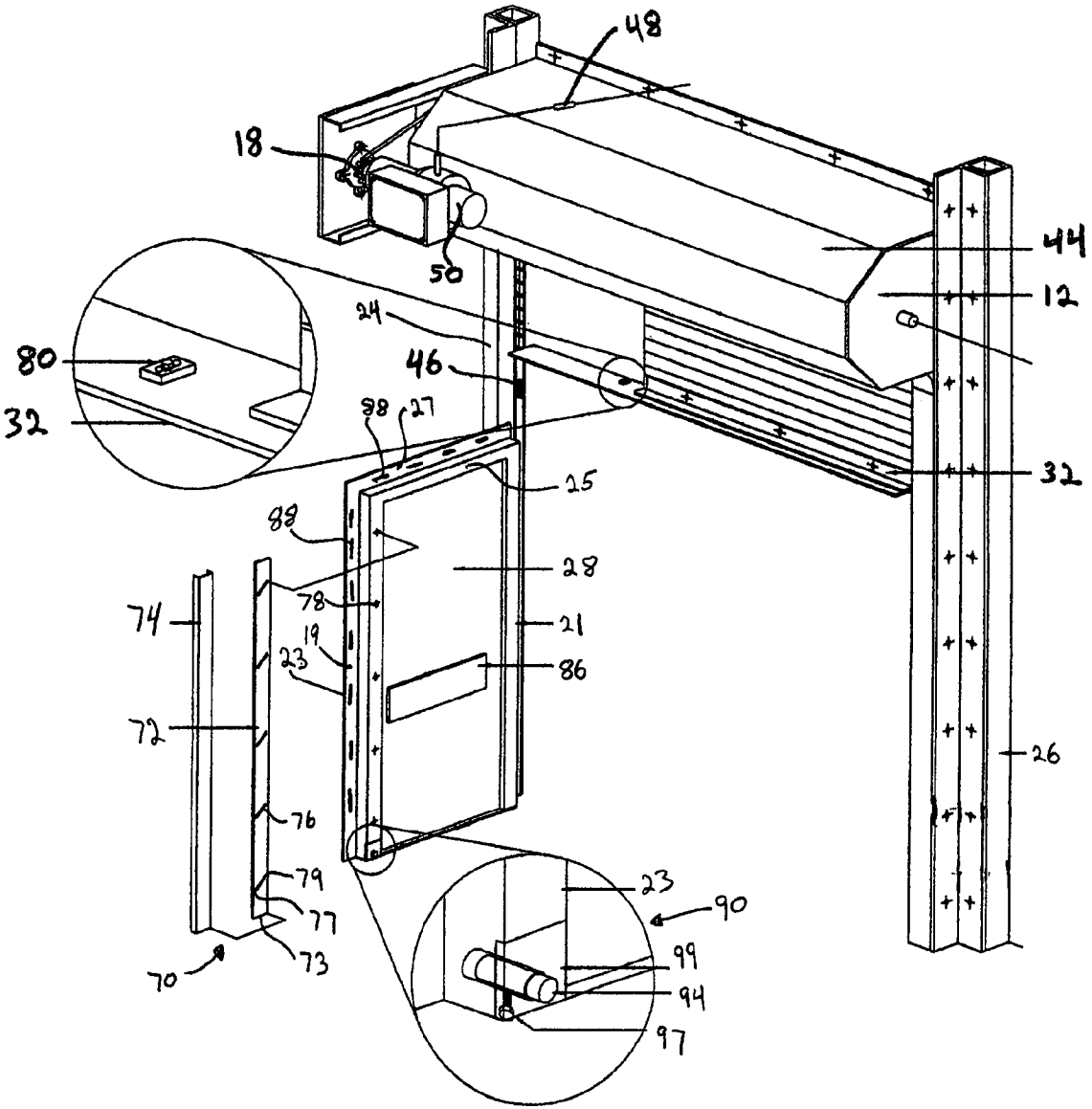
FIG. 10 depicts a partial exploded view of a single door assembly.

With reference to FIGS. 5 and 10, it will be seen that when the lower part 16*b* of the flexible door panel is fully deployed so that the aligning member 32 is positioned on the floor at the bottom of the opening, and the pass door frame 20 is moved from its undeployed second position to its deployed first position, the overlap region 19 will be positioned in front of the vertical edge of the door panel. Likewise, overlap portion 27 will be positioned in front of the lowermost edge of the wide panel portions 16*a*. To provide a seal between the overlap regions 19, 27 and their respective opposing edges on the door panel, a releasable attraction means is provided. In one embodiment, this is accomplished by providing a strip or segments of magnetic material 88 such that when the regions 19 and 27 approach the edges of the flexible panel, adherence therebetween will result.

Figure 6:
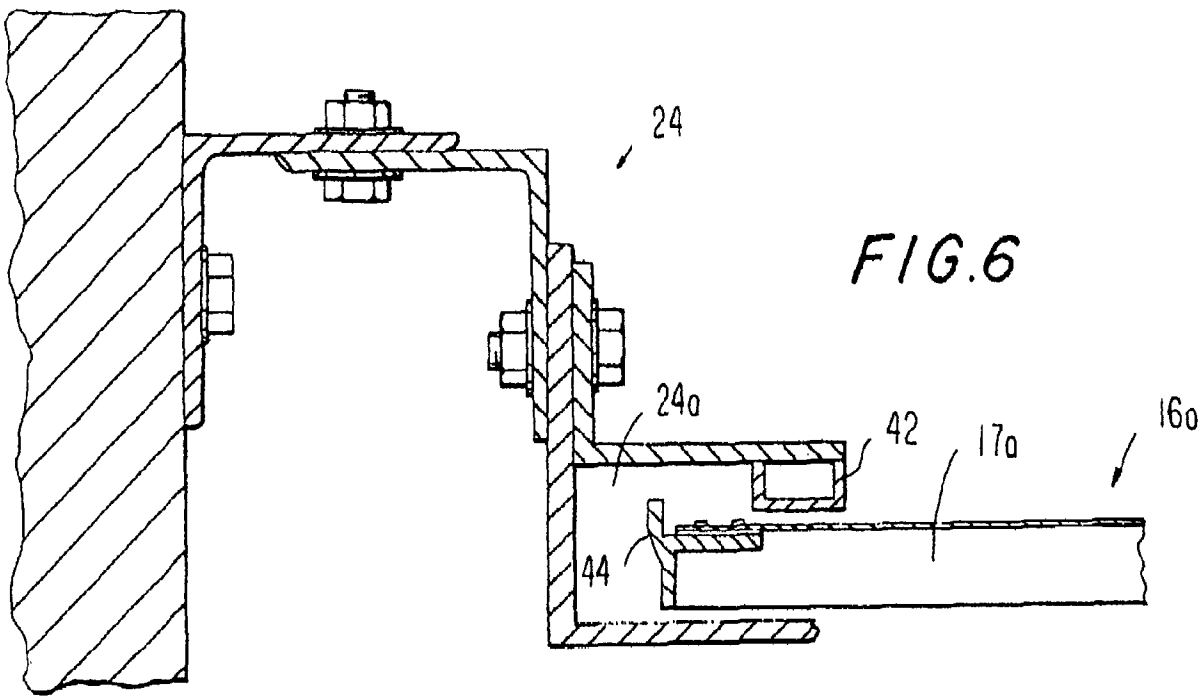
FIG. 6 is a partial cross sectional view taken across line VI-VI in FIG. 1.
Figure 7:
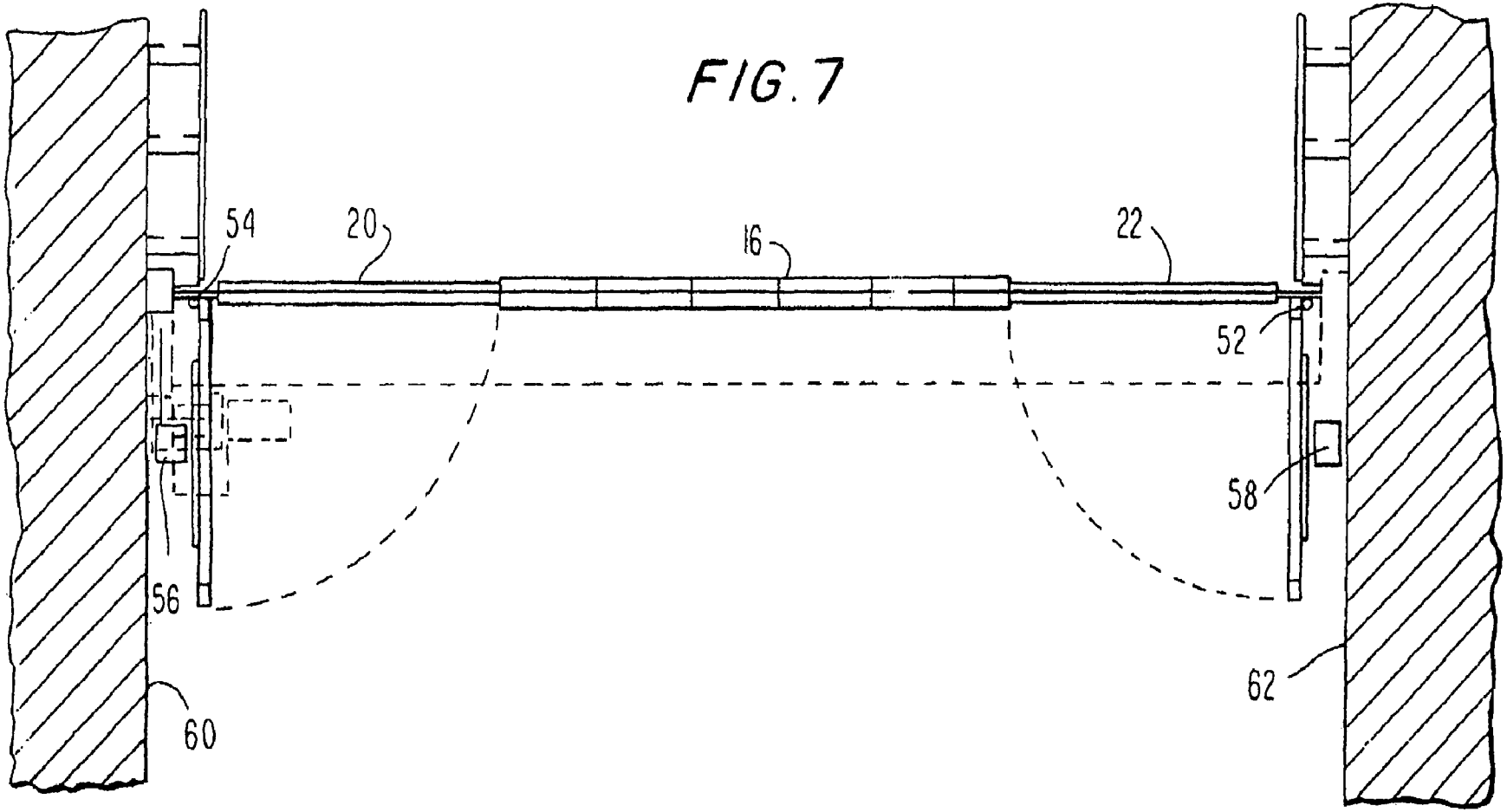
FIG. 7 is a plan view of the fire door assembly of FIG. 1, showing movement of the pass door frames from their respective inactive positions to the closed position when the flexible door panel is closed.

It is also desirable to provide means of preventing lateral movement of upper door portion 16*a* from the channels 24*a*, 26*a* of vertical guide members 24 and 26. Thus, as shown in FIG. 6, the inner surface of each channel (as shown for example, as channel 24*a*) includes an inwardly directed abutment 42 which extends the length thereof. Each slat 17*a* of upper flexible door portion 16*a* has a corresponding extension structure 44 which will engage abutment 42 if any effort is made to dislodge, as by pushing, the flexible panel therefrom.

With simultaneous reference now to FIGS. 1, 3, 7, and 10, the means by which operation of the fire door assembly 10 is controlled will now be described in detail. As shown in FIG. 1, fire door assembly 10 includes a conventional fire door operator mechanism 50 for operating the rotating means 18 after a fire has been detected or upon manual activation of a test sequence. The construction of such mechanisms are well known to those skilled in the art, and a detailed description of the same has therefore been omitted as unnecessary. Typically, such structures include a fusible link mechanism 48 which melts in response to a fire and, immediately or after a predetermined time delay, initiates extension of the flexible door panel 16 across the opening.

As will be readily ascertained by those skilled in the art, each of the pass door frames 20 and 22 along with their respective pass doors must be in the transverse or closed position shown in FIGS. 1 and 10 (for a single door system) to achieve full closure of the door opening. Thus, pass door frames 20 and 22 must be moved from the inactive, or "second" pass door frame positions wherein the frames are substantially aligned with the sidewalls of the openings into their respective closed, or "first" positions wherein the pass door frames are substantially transverse with the flexible panel 16 such that the vertical and horizontal overlap regions engage respective edges of panel 16. In the illustrative embodiment depicted in FIG. 7, a tension spring 52, 54 biases pass door frames 20 and 22, respectively, into the first or closed positions. To retain the pass door frames 20 and 22 in their inactive second positions, in which they are substantially aligned with lateral sidewalls 60 and 62, respectively, the present invention utilizes releasable, latching mechanisms 56 and 58.

Any suitable releasable latching mechanisms may be utilized to retain pass door frames 20 and 22 in their respective open second positions. In the illustrative embodiment of the present invention, electromagnetic latches are utilized. While energized, the pulling force exerted by magnetic latching mechanisms 56 and 58 on pass door frames 20 and 22, respectively, is sufficient to overcome the aforementioned bias of the tension springs 52, 54 and thus prevent the pass door frames from closing. Once latches 56 and 58 are de-energized, such as during a loss of power condition in the event of a fire, pass door frames 20 and 22 are free to move into the closed first position shown in FIGS. 1 and 3.

A variety of operating sequences of the door assembly 10 are possible in response to a test request or a detected condition such as a fire. For example, appropriate circuitry may be provided such that upon receipt of an external input signal indicative of a manual closure request, the panel 16 will close and the supply of electrical power to latches 56 and 58 is disrupted so that the doors may be permitted to close. Alternatively, to avoid nuisance closures, capacitors (not shown) may be coupled between the power supply terminals and the magnetic latch structures such that a predetermined delay such, for example, as 10 seconds, is provided prior to de-energization of latches 56 and 58.

As explained above, the magnets strip 88 on the vertical overlap region 19 and horizontal overlap region 29 provides a seal between a front face of the door panel 16 and the front side of the pass door frames 20, 22. This "one-sided" seal arrangement is insufficient to provide a proper fire retardant interface between the panel 16 and the pass door frames because, for example, the narrow portion of the panel 16*b* could simply be pushed away from magnetic strip, e.g., in a direction perpendicular to the vertical frame section 23. Thus, a guard arrangement 70 is provided to interface the opposite side of the pass door frame (i.e., the side without the vertical overlap region 19), with the opposite side of the narrow panel portion 16*b*.

Figure 9A:
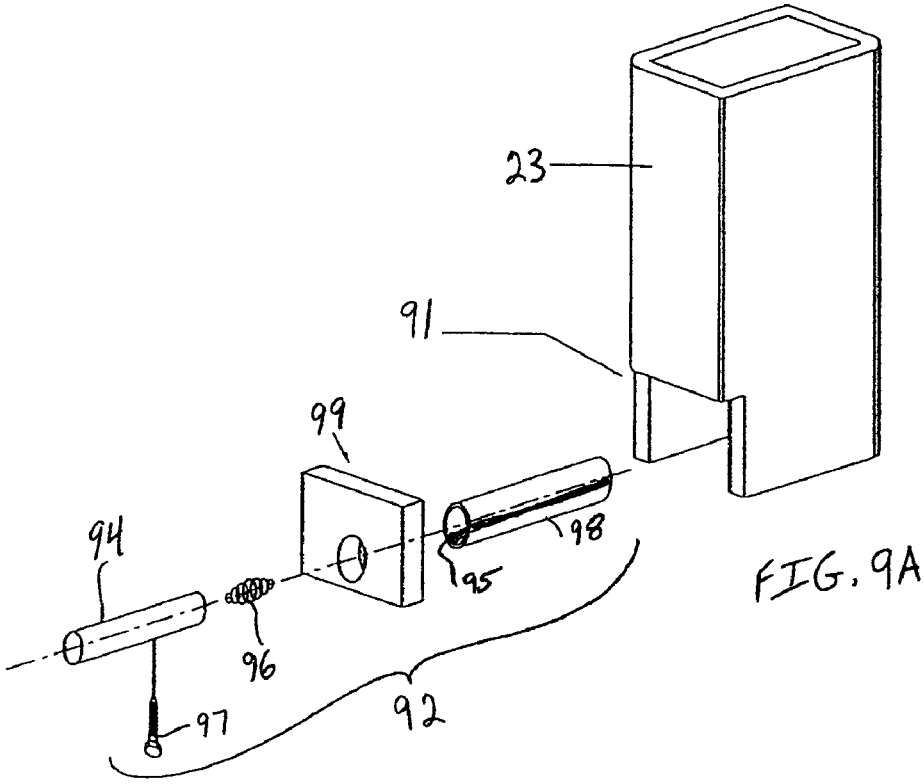
FIGS. 9A-9B show exploded views of sliding guard release actuator.
Figure 9B:
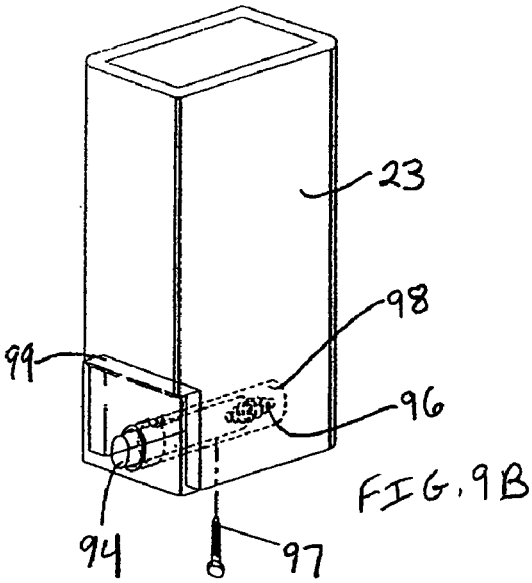

FIG. 10 depicts the rear side of a single pass door arrangement relative to the front view shown in FIGS. 1 and 3. The guard arrangement 70 includes a movable overlap member such as a sliding panel 72 containing one or more parallel, angled slots 76 having a lower first end 77 and a higher second end 79. The movable overlap member or panel 72 is movably mounted to a side of the pass door frame 20 opposite the side of the overlap region 19 via a plurality of anchors or bolts 78. A cover 74 is provided to fit over the sliding panel 72 to conceal the bolts 78 and slots 76. When secured to the pass door frame, a lower edge 73 of the panel rests on a release means 90. As shown in FIGS. 9A and 9B, the release means 90 is mounted in an opening 91 on a bottom portion of the vertical section 23 and includes a retractable plunger assembly 92. The plunger assembly includes a movable plunger 94 extending through a mounting plate 99 into a tubular housing 98 having a rear wall (not shown) and a bottom slot 95. The mounting plate is secured to the vertical section 23 in any manner, such as by welding, rivets, fasteners, etc. The movable plunger 94 is biased outward from the housing 98 by a compression spring 96 seated in the housing. An engagement member 97, shown, for example, as a bolt, is connected to the movable plunger at a location behind the mounting plate 99 (see FIG. 9B) and is movable in a transverse direction along the slot 95 against the bias of the spring 96. The engagement member 97 preferably extends below the bottom edge of the vertical frame section.

With reference to FIG. 8, the actuator 80 is mounted to the aligning member 32 via an adjustment bolt 84. The activator is preferably configured as a block having a slot formed therein which allows the position of the block to be adjusted in a direction perpendicular to the axis of the aligning member 32 in a known manner. The location of the actuator 80 is such that it will contact the engagement member 97 when the pass door frame 20 reaches its fully deployed, first position. At this position, the plunger 94 will move into the housing 98 against the force of the spring 96. This will release the sliding panel 72 to allow the panel to slide down from the lower end 77 to the higher end 79 of the slots 76. Because this action occurs when the actuator 80 is positioned opposite the engagement member 97 such that the flexible door panel 16 is fully closed, the sliding panel 72 will cover the rear side of the vertical edge of the narrow flexible door panel 16*b*. Thus, the vertical edge of the flexible door panel 16*b* will be contained between vertical overlap region 19, on one side, and sliding panel 72 on the other side.

It is desirable to time the closing of the pass door frames 20, 22 as close as possible with the completion of the closing of the flexible door panel such that the actuator 80 on the aligning member 32 is in its proper position on the floor of the doorway opening for interaction with the release means 90. For this purpose, a release switch 46 is provided at a desired height along the track member 24. The release switch can be a mechanical switch or an electrical switch, as is known in the art, and will cause the release of latching structure 56 when the switch 46 is engaged by the aligning member 32. If an electrical switch is used, a separate power source, such as batteries or a dischargeable capacitor should be employed such that the switch will operate in its intended manner in the event of a power outage—a common occurrence during a fire condition—. A time delay can also be employed to ensure that the pass door frames will close only after the aligning member 32 has reached its final position on the floor.

In operation, an emergency condition will cause the flexible door panel to close in a known manner. As the aligning member 32 engages the release switch 46, a signal (delayed or otherwise) will activate the door operator mechanisms to cause the pass door frame 20 to release from its secured second position. As the pass door frame 20 continues to rotate about its axis to its closed position, the flexible panel continues to descend until the aligning member 32 reaches the floor. As the door frame approaches 23 the engaging edges of the flexible door panel, the magnetic strip 88 attracts the door panel 16 and pulls the panel toward the door frame. This occurs as the release means 90 engages the actuator. The movement of the flexible door panel toward the vertical overlap region 19 as a result of the magnetic strip regions 88 provides a clearance to allow the sliding panel. Thus, and as shown in FIG. 5, the narrow portion 16*b* of the flexible panel will be sandwiched between the vertical overlap region 19 on one side, and the sliding guard 70 on the other side.

While there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

The invention claimed is:

1. A fire door assembly for protecting a building opening defined by at least one lateral sidewall, comprising:

a shutter roller rotatable about a substantially horizontal axis;

means for rotating said shutter roller;

a pair of alignment rails, with each rail positioned on a side of the building opening;

a flexible panel windable on and off said shutter roller for movement of said flexible panel into retracted and extended positions, respectively, said flexible panel defining an upper portion having a first width and a lower portion having a second width less than said first width, a leading edge of the lower portion having an aligning member secured thereto, said aligning member having ends guidable in said alignment rails, the aligning member being proximate to the floor when the flexible panel is in the extended position;

a pass door frame hingedly securable proximate a lateral side of the opening for movement between a first position in which said pass door frame extends in a substantially transverse direction relative to the opening, and a second position in which said pass door frame is substantially aligned with said at least one sidewall, said pass door frame having a vertical overlap region extending over a vertical edge of a first side of said lower portion of said flexible panel when said flexible panel is in said extended position and said pass door frame is in said first position, said pass door frame having a movable overlap member movably mounted to a side opposite a side of said vertical overlap region, said movable overlap member being selectively movable from an undeployed position to a deployed position over said vertical edge along a second side of said lower portion of said flexible panel opposite said first side, so that when said movable overlap member is in said deployed position, said vertical edge is positioned between said vertical overlap region and said movable overlap member;

a movable member release means connected to one of said pass door frame and said flexible panel, to cause said movable overlap member to move to the deployed position;

a pass door moveably mounted within the passage defined by said pass door frame to selectively provide ingress and egress therethrough; and closure means for causing said pass door frame to be positioned in said first position after said flexible panel is in the extended position.

2. The fire door assembly of claim 1, wherein said closure means includes means for biasing said pass door frame into said first position and pass door releasable means for releasably retaining said pass door frame in said second position.

3. The fire door assembly of claim 2, wherein said pass door releasable means is responsive to an externally supplied signal to release said pass door frame, thereby allowing said pass door frame to move into said first position.

4. The fire door assembly of claim 2, wherein said pass door releasable means is an electromagnetic device.

5. The fire door assembly of claim 2, further including trigger means activated by movement of said flexible panel, said pass door releasable means being responsive to said trigger means to release said pass door frame.

6. The fire door assembly of claim 5, wherein said trigger means is positioned in one of said alignment rails and causes said pass door releasable means to release said pass door frame.

7. The fire door assembly of claim 1, further comprising means for detecting a fire and wherein said means for rotating said shutter roller is responsive to said fire detecting means to complete extension of said flexible panel prior to said pass door frame moving into said first position.

8. The fire door assembly of claim 1, wherein said closure means is responsive to an externally supplied signal to move said pass door frame from said second position into said first position.

9. The fire door assembly of claim 1, further including hinge means for hingedly securing said pass door frame proximate said lateral sidewall.

10. The fire door assembly of claim 1, wherein said vertical overlap region comprises magnetic means for attracting said vertical edge of said first side of said lower portion of said flexible panel.

11. The fire door assembly of claim 10, further comprising a horizontal overlap region at a top of said pass door frame for overlapping a bottom edge of said upper portion of said flexible panel when said flexible panel is in the extended condition.

12. The fire door assembly of claim 1, wherein said member release means comprises a retractable plunger assembly movable to a retracted position when said pass door frame is moved proximate said aligning member.

13. The fire door assembly of claim 12, wherein a bottom edge of said overlap member is supported by said retractable plunger assembly when said overlap member is in said undeployed position.

14. The fire door assembly of claim 13, further comprising an obstruction on said aligning member at a position opposite said retractable plunger assembly to cause said retractable plunger assembly to retract upon engagement of said obstruction and said retractable plunger assembly.

15. The fire door assembly of claim 1, further including a second pass door frame hingedly securable proximate a second lateral side of the opening for movement between a first position, in which said second pass door frame extends in a substantially transverse direction relative to the opening and a second position, in which said second pass door frame is substantially aligned with a second sidewall opposite said at least one sidewall, said second pass door frame having a vertical overlap region extending over a second vertical edge of a first side of said lower portion of said flexible panel when said flexible panel is in said extended position and said second pass door frame is in said first position, said second pass door frame having a movable overlap member movably mounted to a side opposite a side of said second vertical overlap region, said movable overlap member being selectively movable from an undeployed position to a deployed position over said second vertical edge along a second side of said lower portion of said flexible panel opposite said first side, so that when said movable overlap member of said second pass door frame is in said deployed position, said second vertical edge is positioned between said vertical overlap region and said movable overlap member of said second pass door frame;

a second pass door movably mounted within the passage defined by said second pass door frame to selectively provide ingress and egress therethrough; and second closure means for causing said second pass door frame to be positioned in said first position after said flexible panel is in the extended position.

16. The fire door assembly of claim 15, wherein a sum of widths of said first and second pass door frames does not exceed a difference between the first width and second width.

17. The fire door assembly of claim 16, wherein said first and second pass door frames are of the same width.

18. The fire door assembly of claim 1, further including means for hingedly securing said pass door to said pass door frame.

19. The fire door assembly of claim 1, wherein the movable member release means connected to one of said pass door frame and said flexible panel causes said movable overlap member to move to the deployed position in response to the flexible panel being in the extended position and the pass door frame being in the first position.

* * * * *